United States Patent [19]

Wolfe et al.

[11] 4,182,048

[45] Jan. 8, 1980

[54] METHOD OF DRYING LUMBER

[75] Inventors: Charles M. Wolfe; Steven W. Hinton, both of Jacksonville, Fla.

[73] Assignee: U.S. Natural Resources, Inc., Portland, Oreg.

[21] Appl. No.: 879,396

[22] Filed: Feb. 21, 1978

[51] Int. Cl.[2] ..... F26B 7/00

[52] U.S. Cl. ..... 34/13.4; 34/26

[58] Field of Search ..... 34/13.4, 13.8, 16.5, 34/26

[56] References Cited

U.S. PATENT DOCUMENTS

| | | | |
|---|---|---|---|
| 900,017 | 9/1906 | Howard | 34/13.4 |
| 1,199,120 | 9/1916 | Sidman | 34/26 |
| 1,328,655 | 1/1920 | Fish, Jr. | 34/13.8 |
| 1,503,168 | 7/1924 | Mueller | 34/30 |
| 1,593,598 | 7/1926 | Redman | 34/13.4 |
| 3,234,659 | 2/1966 | Smith | 34/26 |
| 3,262,219 | 7/1966 | Dugger, Sr. | 34/26 |
| 3,404,464 | 10/1968 | Dedrick | 34/26 |
| 3,939,573 | 2/1976 | Berti | 34/16.5 |

OTHER PUBLICATIONS

Brochure "Dry Kiln Practice," The New York State College of Forestry, Jul. 1925.

*Primary Examiner*—John J. Camby
*Attorney, Agent, or Firm*—Klarquist, Sparkman, Campbell, Leigh, Hall & Whinston

[57] ABSTRACT

Lumber within a kiln is subjected to a multi-step process including initial dehumidification drying to a moisture content of approximately 12 to 20 percent followed by drying at a substantially higher temperature without dehumidification. The higher temperature drying step is continued until a moisture content of approximately 6 percent is reached, after which high humidity conditions are preferably introduced into the kiln for equalization and/or conditioning of the lumber.

19 Claims, 3 Drawing Figures

FIG. 1
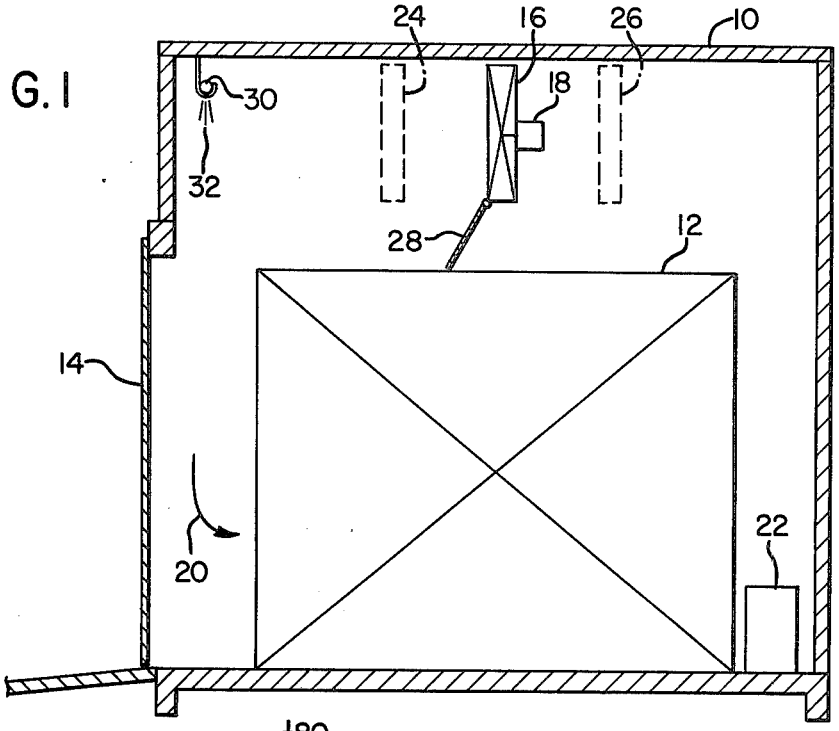
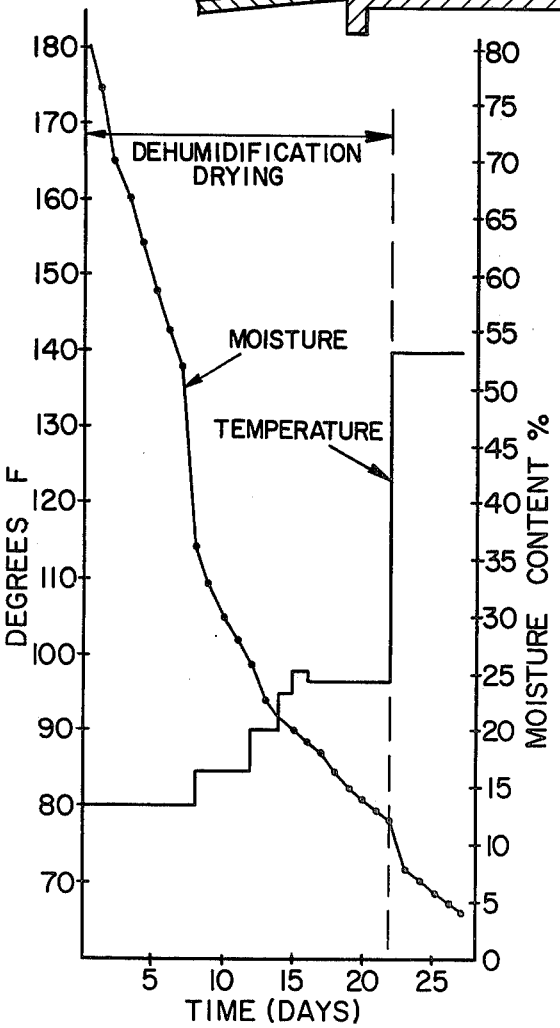
FIG. 2
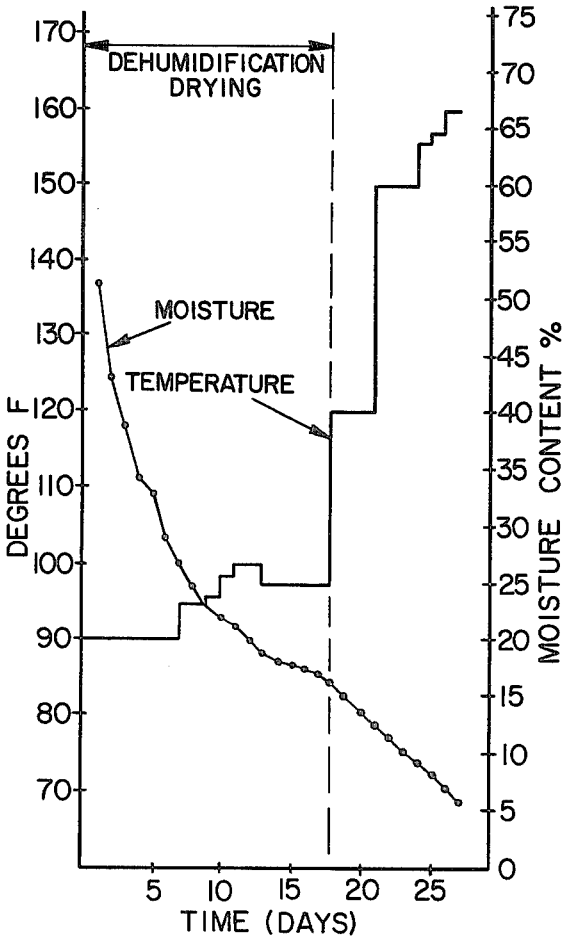
FIG. 3

METHOD OF DRYING LUMBER

BACKGROUND OF THE INVENTION

According to conventional methods for kiln drying hardwoods, the temperature of the lumber is raised to relatively high and increasing levels over a period of days until the moisture content thereof is appropriately lowered. In the case of oak, for example, a time period of 24 to 45 days is typically required. Unfortunately, the temperatures employed, e.g. from 120° F. to 180° F. are apt to degrade hardwood lumber by cracking, splitting, honeycombing or the like.

Less degrade can be achieved at lower temperatures and utilizing dehumidification equipment to achieve consistent results under low temperature conditions. For example, dehumificication drying can be carried on at temperatures from approximately 75° F. to 120° F., but unfortunately appreciably longer residence times for the lumber in the kiln are required. Unless excessive periods of time are consumed, the moisture reduction achieved in a dehumidification process is limited. Moreover, neither equalization or conditioning is practical when only the dehumidification method is used.

Multistage dehumidification processes have been proposed, for example as set forth in U.S. Pat. No. 3,939,573 to Berti wherein the temperature is raised to a small extent in the latter phase of a dehumidification process, but again the moisture reduction possible is limited.

SUMMARY OF THE INVENTION

In accordance with the present invention, lumber in a dry kiln is first subjected to dehumdification drying, wherein the temperature of the air circulating across the lumber is maintained below 120° F., until the average moisture content of the wood drops within the range of 12 to 20 percent. Dehumidification is then discontinued and the temperature of air circulating across the wood is raised substantially, i.e. above 120° F., until the average moisture content of the wood drops below approximately 10 percent and preferably to about 6 percent. The wood is then desirably subjected to high humidity conditions for bringing about equalization and conditioning, wherein the high humidity is provided through introduction of live steam into the kiln as necessary. Conditioning can be described as stress-relieving of the lumber through the absorption of moisture into the surface areas of the boards to equalize the moisture content throughout a board. Equalization refers to the desirable condition of substantially equal moisture content between boards as may be joined together in the same piece of furniture or the like.

As a result of the process according to the present invention, hardwoods can be dried within conventional drying times but without degrade of the lumber. Thus, the entire process according to the present invention can be accomplished within approximately the same period as a conventional (elevated temperature) drying process, but the lumber is not stressed during the early stages of the process such that cracks, honeycombing or the like occur to any extent, thereby resulting in a higher quality product for a given dry kiln residence time. Moreover, a conditioning step results in substantially stress-free lumber. The lumber in the kiln at the end of the present process is conditioned and stabilized at 10 percent or less and preferably at about 6 percent or less moisture content.

It is accordingly an object of the present invention to obtain the advantages of dehumidification drying, i.e. less degrade for producing high quality lumber while still obtaining the drying speed advantages of conventional hardwood drying processes.

It is a further object of the present invention to provide an improved process for producing conditioned hardwood lumber stablized at a moisture content below 10 percent and preferably at about 6 percent.

The subject matter which we regard as our invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

FIG. 1 is a cross-sectional view of a kiln suitably employed according to the drying process of the present invention;

FIG. 2 is a graph plotting temperature within a kiln and moisture content against drying time in days for a first example of a process according to the present invention; and FIG. 3 is a graph plotting kiln temperature and moisture content against drying time in days according to a second example of a process of the present invention.

DETAILED DESCRIPTION

Referring to the drawings and particularly FIG. 1, the process according to the present invention suitably utilizes a kiln 10 comprising a conventional enclosure adapted for drying lumber. The lumber load 12 is received within the structure through door opening 14, such load ordinarily comprising one or more stacks of comparatively green lumber, the boards of which are separated by spacers to allow for the passage of air through the load and over the surfaces of the individual pieces. A fan 16 driven by reversible motor 18 is centrally supported from the top wall of the kiln and is employed for directing an airstream horizontally above the lumber load and then downward, for example along door opening 14. The airstream then passes toward and through the load as indicated by arrow 20, and across the wood surfaces. The airstream exits the load on the opposite side adjacent dehumidifier 22 and returns toward the fan. The fan motor may be reversed for directing the airstream through the load in the opposite direction.

As hereinafter more fully described, dehumidifier 22 lowers the moisture content of the air within the kiln by condensing moisture from said air, thereby drying the lumber with the drier air passing thereover. In the process, the air within the kiln is heated and such heating may be at least in part accomplished utilizing a conventional heat pump dehumidifier 22 adapted to raise the air temperature after cooling the same for removing moisture therefrom. It will be appreciated the dehumidifier 22 generally removes moisture from a small portion of the air within the kiln at any given time. Although the dehumidifier 22 is illustrated as being located within the kiln enclosure, it is also quite feasible to locate such equipment in a separate enclosure having air flow connections with the main kiln.

Supplemental heating apparatus may be employed, for example a conventional electric strip heater at the exit of dehumidifier 22, or heating units 24 and 26 comprising heating coils on either side of fan 16. A hinged baffle 28 extends downwardly from fan 16 to prevent bypassing of load 12 by the airstream. Also, fan 16 is suitably enclosed at the lateral sides thereof, by means not shown, for properly directing the stream of air.

Further supported from the top wall of the kiln is a steam pipe 30 having a multiplicity of perforations on its underside for supplying a humidity spray 32 of live steam. The pipe 30 is preferably positioned such that the steam enters the airstream from fan 16, but does not spray directly upon the load 12. As hereinafter more fully described, the steam spray is selectively operated during one step of the process for the purpose of bringing about conditioning and equalization of the lumber in the load.

According to the process of the present invention, a load of lumber is located within the kiln as illustrated in FIG. 1 and air is circulated within the kiln and across the wood surfaces for drying the wood. The process is continued in essentially two and preferably three steps. The first step involves dehumidification drying at comparatively low temperatures, i.e., below a value of 120° F. and preferably in a range between 80° and 110° F. The temperature is measured where the airstream enters the lumber load, for example as indicated by arrow 20 in FIG. 1, representing the temperature of air circulating across the wood. In the event fan 16 is reversed, the temperature would preferably be measured on the opposite side of the load 12. During this time, dehumidifier 22 is operated, and of course any auxiliary heating devices may be operated as necessary to maintain the temperature in the desired range. Generally speaking, the temperature is raised gradually during the dehumidification portion of the process while the humidity drops. The relative humidity within the kiln typically drops from about 90 percent to about 45 to 50 percent as measured employing the wet and dry bulb thermometer method.

The lower temperature, dehumidification portion of the process is continued until the average moisture content of the wood drops to a value in the range of approximately 12 to 20 percent, and preferably 12 to 16 percent. The moisture content is suitably obtained on a sampling basis by cutting a wafer from a board, weighing such wafer, completely drying the wafer and weighing the same again for ascertaining the moisture content. If the average moisture content is between 12 and 16 percent then the entire load should be below the fiber saturation point such that the cells in the wood no longer contain any free water, although the cell walls or fibers in the wood are still wet or substantially saturated. Stresses caused by trapped water and uneven drying are eliminated. The dehumidification portion of the process takes the wood below the fiber saturation point to avoid degrading of the lumber as by splitting, honeycombing, cupping or the like, as might occur, for example, at higher temperatures not involving dehumidification. As a result, lumber quality is maintained.

In the next step in the process, dehumidification is discontinued, i.e. the dehumidifier is de-energized, and the temperature of the air circulating across the lumber as measured at the location of arrow 20 is raised appreciably, i.e. in the range of 120° to 130° F., with temperatures between 140° and 180° F. being preferred. In practice, the temperature may be raised in stages, for instance first to 140 degrees and then in steps to 150 degrees, 155 degrees and 160 degrees. Alternatively, if dehumidifiction drying was carried out below 100 degrees, the higher temperature phase of the process may begin at a lower temperature, for example 120° F., with subsequent raises in temperature above 140° F. Since the dehumidifier proper is not operated at this time, the heating units 24 and 26, or an electric strip heater as previously mentioned, can be employed for raising the air temperature. The higher temperature range, considerably above the temperatures employed during the dehumidification step, produces rapid drying of the wood to quite low moisture content levels but without degrading the lumber. This high temperature portion of the process is continued until the average moisture content of the wood drops below 10 percent and preferably to about 4 to 6 percent. For some purposes, the wood at this time is quite suitable for its intended use. However, an additional step is preferred according to the process of the present invention for accomplishing equalization and/or conditioning of he lumber.

Equalization refers to equalizing the average moisture content of the lumber as between different boards in the load, while conditioning refers to equalizing the moisture content within a given board, e.g. from its outer surface to its core. Conditioning can be be described as stress-relieving of the lumber and is accomplished through absorption of moisture into the surface areas of the board to equalize the moisture content throughout the board. Conditioning the lumber enhances its resistance to subsequent warping or degrading. Equalization of moisture content between boards is of importance, for example in furniture manufacture where a number of pieces are to be joined permanently and it is required they have substantially identical physical properties, e.g. so far as possible expansion and contraction is concerned.

After the moisture content of the wood has been lowered below 10 percent and preferably to approximately 6 percent in the previous high temperature phase of the process, relatively high humidity conditions are maintained in the kiln to bring about equalization and conditioning. A high relative humidity, for example 70 percent or greater, is produced. Live steam as needed is suitably added by supplying steam to steam pipe 30 in FIG. 1 as hereinbefore described, while the temperature level is approximately the same as in the previous step. Generally, the humidification portion of the process for bringing about equalization and conditioning is continued for a period of about 12 to 24 hours as may be found necessary with the particular type of wood to secure the desired result. Thus, samples from various portions of the load, or various portions of individual boards can be examined for moisture content so as to accomplish equalization and conditioning. After the appropriate time has been ascertained, it can be repeated for other loads of the same type. The equalization and conditioning is accomplished without raising the overall moisture content of the lumber substantially, e.g., from moisture levels below 10 percent and preferably in the vicinity of 6 percent. The lumber in the kiln is conditioned and stabilized at about 6 percent moisture content and stress-free lumber is obtained.

In some instances, the addition of live steam may not be needed or may not be required in quantity because of the moisture removed from the load during the previous, high temperature phase of the process. For example if the kiln walls are effectively sealed for containing moisture within the kiln and moisture is not otherwise removed, the need for added moisture is minimized. However, in most instances the addition of steam is desired for humidifying the air and achieving the aforementioned equalization and conditioning.

A first example of the process according to the present invention is illustrated in graphical form in FIG. 2 where the dry bulb temperature of air circulating across the wood within kiln 10, and the moisture content of the wood, are plotted against time in days. The load in the kiln consisted of one inch thick oak boards. Initially, the temperature of air circulating across the wood was 80° F. and was raised in stages as illustrated to a 97° F. final temperature at the end of a 22 day dehumidification portion of the process. As can be seen, the temperature was maintained at 80 degrees for eight days followed by a raising in temperature to 85 degrees for an additional 4 days, totaling 12 days. Thereafter, the temperature was raised to 90 degrees until the end of 14 days followed by a temperature level of 95 degrees for an additional day. During the sixteenth day the temperature in the kiln was 98 degrees after which the temperature dropped to 97 degrees until the end of the dehumidification drying phase of the process. The wet bulb temperature in the kiln was initially 77° F., and at the end of the period was 81° F. The wood moisture content at the end of dehumidification drying was 12 percent. At the end of the dehumidification drying, the dry bulb temperature of air circulating across the wood was raised substantially to a temperature of 140° F. while operation of the dehumidifier 22 was discontinued. The higher temperature portion of the process without dehumidification was continued for five more days with the moisture content in the wood dropping to about 4 percent. The thoroughly dried lumber showed no signs of splitting or other degrading. The graph does not illustrate the further step of humidification for the purpose of accomplishing conditioning and equalization, such step involving an additional day at the higher temperature with the introduction of live steam.

In accordance with a further example as illustrated in FIG. 3, the load comprised two inch thick maple lumber. The initial dry bulb temperature for air circulating across the wood was 90 degrees and the concluding temperature at the end of 17 days of dehumidification drying was 98° F. During the same period, the wet bulb temperature within the kiln dropped from 87 degrees to 85 degrees. The moisture content of the wood at this time was 16 percent. Thereupon, the dehumidification was discontinued and the temperature was raised to a level of 120 degrees for 3 days followed by a temperature of 150 degrees for 3 more days. On successive days thereafter the temperature was raised to 156 degrees, 157 degrees and 160 degrees, with the high temperature portion of the process ending after 27 days. The moisture content at this time was 6 percent with no cracking or other degrading being evidenced in the lumber. Again, a final equalization and conditioning step is not illustrated on the graph, but it involves an additional 24 hours under high humidity conditions.

It is seen the process according to the present invention results in kiln dried lumber which is conditioned and stablized at about 6 percent moisture content. Moreover, this high quality product is produced without consuming excessive kiln time since the process can be accomplished in approximately the same time period as conventional hardwood drying. Although the process according to the present invention is primiarly economic for hardwoods, it can also be applied to softwoods if so desired.

While we have shown and described a preferred embodiment of our invention, it will be apparent to those skilled in the art that many changes and modifications may be made without departing from our invention in its broader aspects. We therefore intend the appended claims to cover all such changes and modifications as fall within the true spirit and scope of our invention.

We claim:

1. A method of drying wood comprising the steps of:

(a) positioning said wood within a substantially closed drying kiln, (b) circulating air within said kiln across said wood under controlled temperature conditions, (c) dehumidifying the air within said kiln while maintaining the temperature of air circulating across said wood below a value of 120° F. until the average moisture content of said wood drops within the range of approximately 12 to 20 percent, (d) discontinuing said dehumidification of the air within said kiln and heating the air circulating across said wood above 120° F. but below 180° F. until the average moisture content of said wood drops below approximately 10 percent.

2. The method according to claim 1 wherein the temperature of the air circulating across said wood in step (c) is within the range of 80° to 110° F.

3. The method according to claim 1 wherein the temperature of the air circulating across said wood in step (d) is in the range of 140° to 180° F.

4. The method according to claim 1 wherein step (c) is continued until the average moisture content of said wood drops to a value between approximately 12 and 16 percent.

5. The method according to claim 1 wherein step (d) is continued until the average moisture content in said wood drops to about 6 percent.

6. The method according to claim 1 wherein the relative humidity within said kiln at the end of step (c) is reduced to less than approximately 50 percent.

7. A method of drying wood comprising the steps of:

(a) positioning said wood within a drying kiln, (b) circulating air within said kiln across said wood under controlled temperature conditions, (c) dehumidifying the air within said kiln while maintaining the temperature of air circulating across said wood below a value of 120° F. until the average moisture content of said wood drops within the range of approximately 12 to 20 percent, (d) substantially increasing the temperature of air circulating across said wood above a value of 120° F. until the average moisture content of said wood drops below approximately 10 percent, and (e) increasing the humidity level within said kiln for equalizing the moisture content and conditioning of said wood by absorption of moisture into the surface areas of said wood under high humidity conditions.

8. The method according to claim 7 including discontinuing the dehumidification of the air within said kiln after step (c).

9. The method according to claim 7 wherein the humidity level within said kiln is increased during step (e) to above approximately 70 percent.

10. The method according to claim 7 wherein the humidity level is increased within said kiln during step (e) by introducing moisture into air circulating across said wood.

11. The method according to claim 10 wherein said moisture introduced into said kiln is in the form of live steam.

12. The method according to claim 7 wherein the temperature of the air circulating across said wood in step (c) is within the range of 80° to 110° F.

13. The method according to claim 7 wherein the temperature of the air circulating across said wood in step (d) is in the range of 140° to 180° F.

14. The method according to claim 7 wherein step (c) is continued until the average moisture content of said wood drops to a value between approximately 12 and 16 percent.

15. The method according to claim 7 wherein step (d) is continued until the average moisture content in said wood drops to about 6 percent.

16. The method according to claim 7 wherein the relative humidity within said kiln at the end of step (c) is reduced to less than approximately 50 percent.

17. A method of drying wood comprising the steps of:

(a) positioning said wood within a substantially closed drying kiln, (b) circulating air within said kiln across said wood under controlled temperature conditions, (c) dehumidifying the air within said kiln while maintaining the temperature of ai circulating across said wood below a value of 120° F. until the average moisture content of said wood drops within the range of approximately 12 to 20 percent, and (d) heating the air circulating across said wood above 120° F. but below 180° F. until the average moisture content of said wood drops below approximately 10 percent.

18. The method according to claim 17 wherein the temperature of the air circulating across said wood in step (d) is in the range of 140° to 180° F.

19. The method according to claim 17 wherein step (c) is continued until the average moisture content of said wood drops to a value between approximately 12 and 16 percent.

* * * * *

UNITED STATES PATENT AND TRADEMARK OFFICE

CERTIFICATE OF CORRECTION

PATENT NO. : 4,182,048

DATED : January 8, 1980

INVENTOR(S) : CHARLES M. WOLFE AND STEVEN W. HINTON

It is certified that error appears in the above—identified patent and that said Letters Patent is hereby corrected as shown below:

Column 3, line 68, "130° F." should be --180° F.--.

Column 4, line 23, "he" should be --the--.

Column 8, line 8, claim 17, "ai" should be --air--.

Signed and Sealed this

*Sixteenth* Day of *March 1982*

[SEAL]

*Attest:*

GERALD J. MOSSINGHOFF

*Attesting Officer*

*Commissioner of Patents and Trademarks*